US008200136B2

(12) United States Patent
DiRubio et al.

(10) Patent No.: US 8,200,136 B2
(45) Date of Patent: Jun. 12, 2012

(54) IMAGE TRANSFER ROLLER (ITR) UTILIZING AN ELASTOMER CROWN

(75) Inventors: Christopher A. DiRubio, Webster, NY (US); Paul F. Sawicki, Rochester, NY (US); Thomas C. Keyes, Fairport, NY (US); Edward W. Schnepf, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/868,936

(22) Filed: Aug. 26, 2010

(65) Prior Publication Data

US 2012/0051803 A1 Mar. 1, 2012

(51) Int. Cl.
*G03G 15/16* (2006.01)

(52) U.S. Cl. ..... 399/313; 399/121; 399/297; 399/318

(58) Field of Classification Search ..... 399/121, 399/297, 313, 318
See application file for complete search history.

(56) References Cited

U.S. PATENT DOCUMENTS

| | | | | |
|---|---|---|---|---|
| 3,781,105 | A | 12/1973 | Meagher | |
| 6,606,477 | B2 | 8/2003 | Thompson et al. | |
| 6,611,665 | B2 | 8/2003 | DiRubio et al. | |
| 7,177,572 | B2 | 2/2007 | DiRubio et al. | |
| 7,218,883 | B2 * | 5/2007 | Aruga et al. | 399/302 |
| 7,242,894 | B2 | 7/2007 | Kuo et al. | |
| 2008/0056766 | A1 * | 3/2008 | Furuya | 399/176 |
| 2008/0152369 | A1 | 6/2008 | DiRubio et al. | |
| 2008/0152371 | A1 | 6/2008 | Burry et al. | |
| 2009/0304408 | A1 | 12/2009 | Dirubio et al. | |

FOREIGN PATENT DOCUMENTS

JP 2007286522 A * 11/2007

OTHER PUBLICATIONS

English Abstract to Kutsuwada et al. JP2007286522A.*
U.S. Appl. No. 12/581,281, Oct. 19, 2009, DiRubio et al.

* cited by examiner

*Primary Examiner* — Ryan Walsh
(74) *Attorney, Agent, or Firm* — Fay Sharpe LLP

(57) ABSTRACT

Disclosed is an image transfer roller (ITR) utilizing an elastomer crown, imaging devices and imaging apparatus using the disclosed ITR. According to one exemplary embodiment, an ITR includes a cylindrically shaped conductive shaft and an elastomer material covering all or a portion of the conductive shaft. The profile of the outer surface of the elastomer material includes a substantially quadratic crown profile.

22 Claims, 9 Drawing Sheets

IMAGE TRANSFER ROLLER (ITR) UTILIZING AN ELASTOMER CROWN

BACKGROUND

The present exemplary embodiments relate to document processing systems such as printers, copiers, multi-function devices, etc., and operating methods for mitigating retransfer associated with the transfer of toner from a first substrate to a second substrate. Examples of the failure modes associated with retransfer include, but are not limited to, image noise, image mottle, deletions, color shifts, poor color macro-uniformity, poor color stability, and cross color developer contamination. Multi-color toner-based Xerographic printing systems typically employ two or more xerographic marking devices to individually transfer toner of a given color to an intermediate image transfer medium, such as a drum or belt, with the toner being subsequently transferred from the intermediate medium to a sheet or other final print medium, after which the twice transferred toner is fused to the final print. Retransfer occurs when toner on the intermediate image transfer belt from previous, upstream marking devices is wholly or partially removed (scavenged) due to high fields within the transfer nip. High fields in the transfer nips in the previous downstream marking devices can adversely modify the charge state of the toner on the intermediate image transfer medium, such as an intermediate image transfer belt (ITB), through air breakdown mechanisms, further exacerbating retransfer. When this happens, the desired amount of one or more toner colors is not transferred to the final printed sheet, and the retransfer problem worsens as the number of colors increases. Retransfer at a given marking device may be reduced by lowering the transfer field strength at that device, but this may lead to incomplete transfer during image building at that device. In other words, the transfer nip may be transferring toner to the intermediate ITB at one region in the cross-process direction (image building), which requires high fields, while simultaneously scavenging toner from the intermediate ITB in another region (retransfer). In addition, the quality requirements of multi-color document processing systems are constantly increasing, with customers demanding the improved imaging capabilities without the adverse effects of retransfer and incomplete transfer. Accordingly, a need remains for improved multi-color document processing systems and an improved transfer mechanism design through which retransfer and the aforementioned problems can be mitigated.

INCORPORATION BY REFERENCE

The following patents and patent application publications are totally incorporated herein by reference:

U.S. Pat. No. 6,611,665 to DiRubio et al., entitled "Method and Apparatus using a Biased Transfer Roll as a Dynamic Electrostatic Voltmeter for System Diagnostics and Closed Loop Process Controls," issued Aug. 26, 2003.

U.S. Pat. No. 6,606,477 to Thompson et al., entitled "Method to Control Pre- and Post-Nip Fields for Transfer," issued Aug. 12, 2003.

U.S. Pat. No. 3,781,105 to Meagher, entitled "Constant Current Biasing Transfer System," issued Dec. 25, 1973.

U.S. Patent Application Publication No. 2009/0304408 to DiRubio et al., entitled "Multi-Color Printing System and Method for High Toner Pile Height Printing," published Dec. 10, 2009.

U.S. Patent Application Publication No. 2008/0152369 to DiRubio et al., entitled "Method of Using Biased Charging/Transfer Roller as In-Situ Voltmeter and Photoreceptor Thickness Detector and Method of Adjusting Xerographic Process with Results," published Jun. 26, 2008.

U.S. Patent Application Publication No. 2008/0152371 to Burry et al., entitled "Photoconductor Life Through Active Control of Charger Settings," published Jun. 26, 2008.

BRIEF DESCRIPTION

In one embodiment of this disclosure, described is an image transfer roller (ITR) for the transfer of an image from a first substrate to a second substrate comprising a shaft, the shaft including a first longitudinal end and a second longitudinal end; and an elastomer material covering all or a portion of the shaft, the outer surface of the elastomer material adapted to have a substantially quadratic crown profile, wherein the image transfer roller is operatively associated with generating a uniform image transfer electrical field across a nip for the transfer of an image from the first substrate to the second substrate, the nip associated with the longitudinal engagement of the elastomer material with one of the first and second substrates by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material.

In another aspect of this disclosure, described is an image marking device comprising a photoreceptor drum; an exposure station operatively associated with the photoreceptor drum and configured to form an electrostatic image on the photoreceptor drum; a developer system operatively associated with the photoreceptor drum and configured to develop the electrostatic image with a toner material; an intermediate image transfer belt operatively associated with the photoreceptor drum; an image transfer roller (ITR) operatively associated with the transfer of the developed electrostatic image from the photoreceptor drum to the intermediate image transfer belt, the ITR comprising a shaft, the shaft including a first longitudinal end and a second longitudinal end; and an elastomer material covering all or a portion of the shaft, the outer surface of the elastomer material adapted to have a substantially quadratic crown profile, wherein the image transfer roller is operatively associated with generating a uniform image transfer electrical field across a nip for the transfer of the developed image from the photoreceptor drum to the intermediate image transfer belt, the nip associated with the longitudinal engagement of the elastomer material with one of the intermediate image transfer belt and the photoreceptor drum by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material.

In still another embodiment of this disclosure, described is an image marking apparatus comprising an intermediate image transfer belt; a plurality of image marking devices operatively associated with the transferring of an image to the intermediate image transfer belt, each image marking device associated with a distinct toner material colorant; and an image transfer station operatively associated with the transfer of an image from the intermediate image transfer belt to a media substrate, wherein each image marking device comprises a photoreceptor drum; an exposure station operatively associated with the photoreceptor drum and configured to form an electrostatic image on the photoreceptor drum; a developer system operatively associated with the photoreceptor drum and configured to develop the electrostatic image with a toner material; an image transfer roller (ITR) operatively associated with the transfer of the developed electrostatic image from the photoreceptor drum to the intermediate image transfer belt, the ITR comprising a shaft, the shaft including a first longitudinal end and a second longitudinal end; and an elastomer material covering all or a portion of the shaft, the outer surface of the elastomer material adopted to have a substantially quadratic profile, wherein the image transfer roller is operatively associated with generating a uniform image transfer electrical field across a nip for the transfer of the developed image from the photoreceptor drum to the intermediate image transfer belt, the nip associated with the longitudinal engagement of the elastomer material with one of the intermediate image transfer belt and the photoreceptor drum by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material.

DETAILED DESCRIPTION

This disclosure provides Image Transfer Rollers (ITRs) with an optimized roll crown profile to address within-page color macrouniformity and mottle defects whose root cause is a non-uniform nip pressure and nip width which results in a non-uniform transfer efficiency inboard to outboard.

An uncrowned ITR, for example a bias able transfer roller and/or a backup roller, of constant rubber diameter that is end loaded against a photoreceptor drum does not present a constant transfer nip width across the process direction due to shaft flexure. Nip pressures and widths can be significantly greater at the ends of the ITR relative to the center resulting in higher transfer fields at the ends of the ITR. As a result, toner transfer efficiency from the photoreceptor to an intermediate image transfer surface, such as an intermediate ITB (Image Transfer Belt), varies across the page with a concomitant change in transferred and re-transferred (scavenged) mass, resulting in a within page color variation with a "smile" profile. This problem is especially evident for overlay colors such as red and green, where the darkness and hue (color) near the inboard and outboard edges of the page will differ from the center, or the severity of image mottle may vary between the edges of the page and the center. A crowned ITR compensates for shaft flexure by gradually increasing the ITR diameter when going from the ends to the center of the roller.

Figure 1:
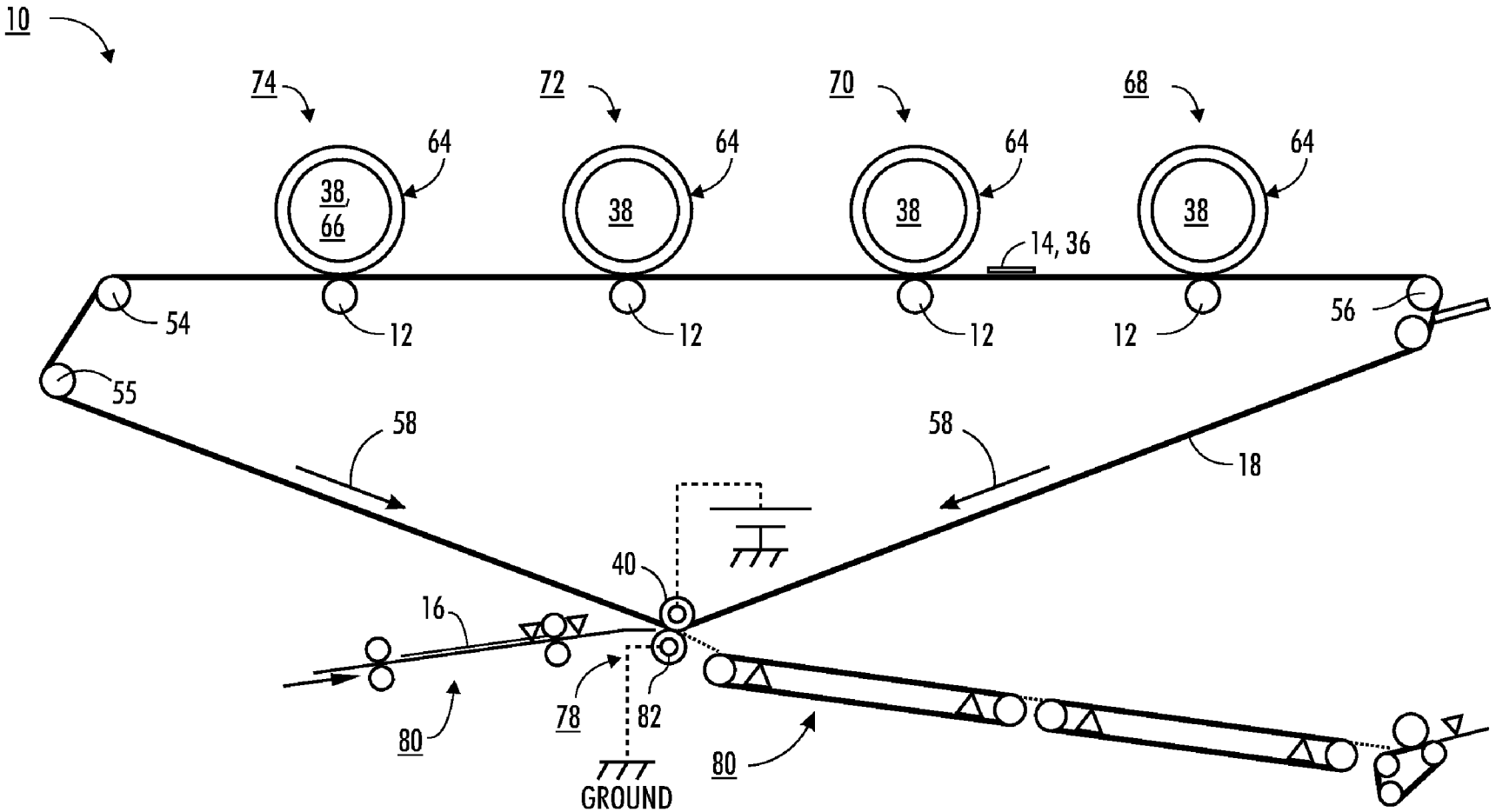
FIG. 1 is a schematic of a xerographic printer implementing one exemplary embodiment of an image transfer roll (ITR) according to this disclosure.

Referring to FIG. 1, there is shown a schematic view of a xerographic printer 10, such as a copier or laser printer, incorporating features of the present disclosure. Although the present disclosure will be described with reference to the embodiment shown in the drawings, it should be understood that the present disclosure can be embodied in many alternate forms of embodiments. In addition, any suitable size, shape or type of elements or materials could be used.

With reference to FIG. 1, illustrated is xerographic printer 10 which includes at least one biased first image transfer roll 12. Many xerographic printers 10 use at least one biased first image transfer roll 12 for transferring imaged toner 14 to a sheet-type substrate 16 or an intermediate image transfer belt 18 as shown in FIG. 1. While transferring imaged toner 14 initially to an intermediate image transfer belt and subsequently to a sheet type substrate has been shown and described, the present disclosure is not so limited, as image transfer rolls can also be used to transfer to continuous rolls of paper, without departing from the broader aspects of the present disclosure. Some high volume xerographic printers 10 may have five or more biased image transfer rolls 12, while many low volume xerographic printers 10 have at least one biased image transfer roll 12.

U.S. Pat. No. 3,781,105 discloses some examples of a biased image transfer roll used in a xerographic printer. Some of the details disclosed therein may be of interest as to teachings of alternatives to details of the embodiment herein.

Figure 2:
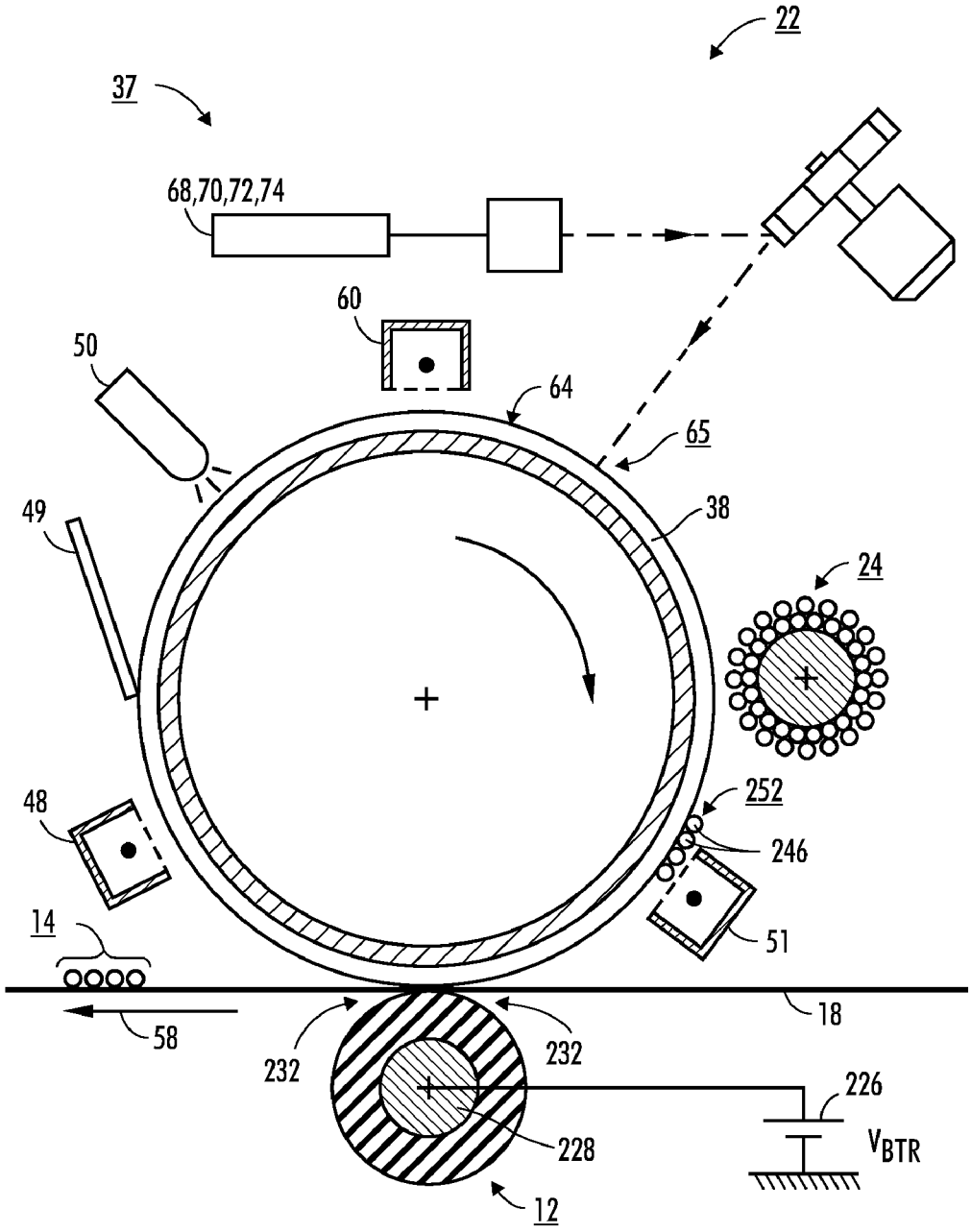
FIG. 2 is a schematic of one exemplary embodiment of a xerographic station incorporating an image transfer roll according to this disclosure.

Referring now to FIG. 2, the biased first image transfer roll 12 is generally operated in a constant current mode, in which a high voltage power supply 226 varies a voltage ($V_{ITR}$) applied to a steel shaft 228 of the biased image transfer roll 12 to maintain a constant current. In one embodiment, changes in the level of voltage of the biased image transfer roll 12 can be used to indicate a change in the electric field in air gaps leading to and from each nip, which is the contact or almost contact area having small or zero air gaps between the biased image transfer roll 12 and, for example, a photoconductor drum 38. A nip region 232 generally includes the air gaps upstream of the nip (pre-nip region), and the air gaps downstream of the nip (post-nip region). The biased image transfer roll 12 can function in a dynamic mode where the components 36, such as photoreceptor, belts and toner, are moving through the nip region 232.

Notably, the electric field of the biased image transfer roll 12 in the nip region 232 can be affected by an electrical field generated by components 36 of the xerographic printer 10 passing through the nip region 232. The voltage ($V_{ITR}$) applied to the shaft 228 of the biased image transfer roll 12 shifts in response to changes in the operating properties of subsystems 22, and the electrical field and/or charge and/or thicknesses of the various components 36 of the subsystems 22.

Before describing the particular features of the present disclosure in detail, an exemplary xerographic printer 10 will be further described, which can be a black and white or multicolor copier or laser printer. To initiate the copying process, a multicolor original document is positioned on a raster input scanner (RIS) which captures the entire image from original document which is then transmitted to a raster output scanner (ROS) 37. The raster output scanner 37 illuminates a charged portion of a photoconductor 64 of a photoconductor drum (OPC) 38, or photoconductor drums 38, of a xerographic printer 10. While a photoconductor drum 38 has been shown and described, the present disclosure is not so limited, as the photoconductor surface 64 may be a type of belt or other structure, without departing from the broader aspects of the present disclosure. The raster output scanner 37 exposes each photoconductor drum 38 to record one of the four subtractive primary latent images.

Continuing with FIG. 2, one latent image is to be developed 24 with a cyan developer material, which is a type of toner 246. Another latent image is to be developed 24 with magenta developer material, a third latent image is to be developed 24 with yellow developer material, and a fourth latent image is to be developed 24 with black developer material, each on their respective photoconductor drums 38. These developed images 252 are charged with a pre-transfer subsystem 51 and sequentially transferred to an intermediate belt 18, and subsequently transferred to a copy sheet 16 in superimposed registration with one another to form a multicolored image on the copy sheet which is then fused thereto to form a color copy. The photoconductor drum 38 is cleaned after the transfer with the use of a pre-clean subsystem 48, a clean subsystem 49 and an erase lamp 50.

Referring again to FIG. 1, the xerographic printer 10 can include an intermediate image transfer belt 18 which is entrained about the 1st image transfer rolls 12, 2nd image transfer rolls 40 and 82, tensioning rollers 54, steering roller 55, and drive roller 56. As drive roller 56 rotates, it advances the intermediate image transfer belt 18 in the direction of arrow 58 to sequentially advance successive portions of the intermediate image transfer belt 18 through the various processing stations disposed about the path of movement thereof. The intermediate image transfer belt 18 usually advances continuously as the xerographic printer operates.

Referring to FIG. 2, initially, a portion of each of the photoconductor drums 38 passes through a charging station 60. At the charging station 60, a corona generating device or other charging device generates a charge voltage to charge the photoconductive surface 64 of each photoconductor drum 38 to a relatively high, substantially uniform voltage potential ($V_{opc}$).

As shown in FIG. 2, each charged photoconductor drum 38 is rotated to an exposure station 65. Each exposure station 65 receives a modulated light beam corresponding to information derived by raster input scanner having a multicolored original document positioned thereat. Alternatively, in a laser printing application the exposure may be determined by the content of a digital document. The modulated light beam impinges on the surface 64 of each photoconductor drum 38, selectively illuminating the charged surface 64 to form an electrostatic latent image thereon. The photoconductive surface 64 of each photoconductor drum 38 records one of three latent images representing each color. The fourth photoconductive drum 66 is used for either color or black and white documents.

After the electrostatic latent images have been recorded on each photoconductor drum 38, the intermediate image transfer belt 18 is advanced toward each of four xerographic stations indicated by reference numerals 68, 70, 72 and 74. The full color image is assembled on the intermediate image transfer belt 18 in four first transfer steps, one for each of the primary toner colors. Xerographic stations 68,70,72,74 respectively, apply toner particles of a specific color on the photoconductive surface 64 of each photoconductor drum 38.

Referring again to FIG. 2, as the intermediate image transfer belt 18 passes by each xerographic station 68,70,72,74, the respective photoconductor drum 38 rotates with the movement of the intermediate image transfer belt 18 to synchronize the movement of the toner image 14 laid down on the intermediate image transfer belt 18 by the previous xerographic station(s) 68,70,72, with the rotation of the toner 252 on each photoconductor drum 38. Each developed image 252 recorded on each of the photoconductive surfaces 64 of each photoconductor drum 38 is transferred, in superimposed registration with one another, to the intermediate image transfer belt 18 for forming the multi-color copy 14 of the colored original document.

Continuing with FIG. 2, the convergence of the biased image transfer roll 12 and each photoconductor drum 38 form the nip 232 in which the toner particles 252 from the photoconductor surface 64 and the intermediate image transfer belt 18 enter synchronously. The biased image transfer roll 12 causes the toner image 252 on the photoconductor drum 38 to transfer to the intermediate image transfer belt 18, and merge with any toner particles 14 previously transferred to the intermediate image transfer belt 18. As the transfer begins, the surface 64 of the photoconductor drum 38, the intermediate image transfer belt 18, and any toner 14, 252 present on either, enter the air gaps associated with nip region 232.

Referring to FIG. 1 and FIG. 2, after development 24 and subsequent transfer of each color to the Intermediate image transfer belt 18, the toner image 14 is moved to a transfer station 78 which defines the position at which the toner image 14 is transferred to a sheet of support material 16, which may be a sheet of plain paper or any other suitable support substrate. A sheet transport apparatus 80 moves the sheet 16 into contact with intermediate image transfer belt 18. During sheet transport, the sheet 16 is moved into contact with the intermediate image transfer belt 18, in synchronism with the toner image 14 developed thereon.

As shown in FIG. 1, the toner image 14 on the intermediate image transfer belt 18 is transferred, in superimposed registration with one another, to the sheet for forming the multicolor copy of the colored original document. The backup roll 40 together with a second biased image transfer roll 82 transfer the toner image 14 to the sheet-type substrate 16. Conventionally, a high voltage is applied to the surface of the backup roller 40 using a steel roller. The image transfer roll 82 shaft is grounded. This creates an electric field that pulls the toner 14 from the intermediate image transfer belt 18 to the substrate 16.

The sheet transport system 80 directs the sheet for transport to a fusing station and removal to a catch tray. Each photoconductor drum 38 also includes a cleaning station including a pre-clean subsystem 48, and a clean subsystem 49 for removing residual toner. An erase lamp subsystem 50 removes residual charge.

The foregoing description should be sufficient for purposes of the present application for patent to illustrate the general operation of a xerographic printer 10 incorporating the features of the present disclosure. As described, a xerographic printer 10 may take the form of any of several well-known devices or systems. Variations of specific xerographic processing subsystems 22 or processes may be expected without affecting the operation of the present disclosure.

As previously discussed, the first transfer ITRs in Tandem Intermediate Belt transfer print engines can be crowned to help mitigate both a cross-process color macro-uniformity defect known as retransfer smile, and a cross-process variation in the severity of image mottle. In some cases, however, the ITR elastomer has a non-optimal trapezoidal crown profile due to poor crown design. As a result, the retransfer smile defect is observed in the field which can result in service calls and an increase in overall run cost.

Now is described a set of ITR design rules and exemplary embodiments according to these design rules for a simple, easily manufactured, near-optimal ITR elastomer crown profile that essentially eliminates image non-uniformities such as the retransfer smile cross-process macro-uniformity defect. Nip mechanics simulations indicate that ITRs with a quadratic crown profile have a very uniform nip width across the process. The uniform nip-width insures that the transfer field is also uniform. This, in turn, insures uniform cross-process retransfer scavenging, thereby eliminating the retransfer smile defect.

Unfortunately a quadratic crown profile is difficult and expensive to manufacture. Design rules are provided for a less expensive, easily manufactured trapezoidal crown specification that results in a nearly quadratic crown profile. The length of the ramp region ($L_0$) of an optimal trapezoidal crown profile is $L_0$=0.33 L, where L is the total length of the ITR elastomer. In contrast, other printing systems employ a non-optimal trapezoidal design with a crown amplitude and a ramp length that are both too small, for example $L_0$/L=0.21.

Figure 3:
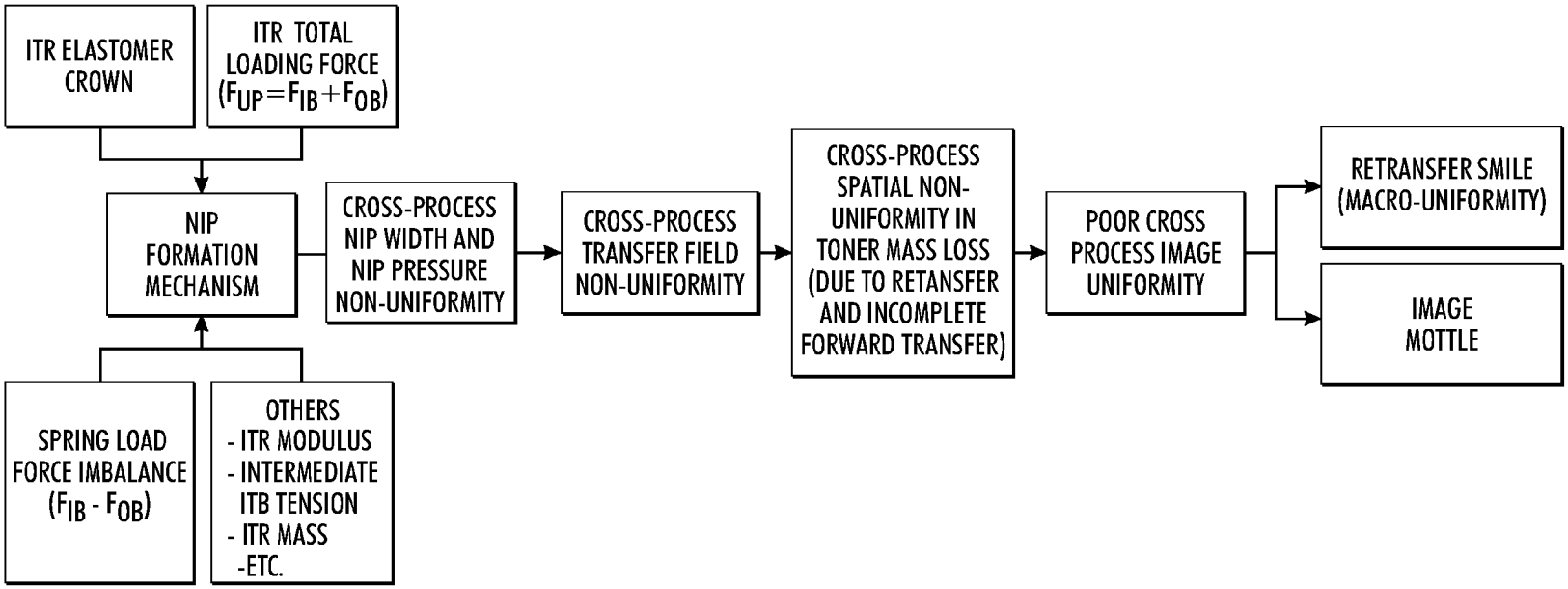
FIG. 3 illustrates the relationships among nip mechanics, the ITR elastomer crown and the retransfer defect known as macro-uniformity smile.

In order to eliminate the cross-process retransfer smile macro-uniformity defect (see FIG. 3), the image transfer field must be made uniform across the process.

To achieve a uniform image transfer field, the nip width must be uniform across the process.

To achieve a uniform nip width, the ITR elastomer must have a nearly quadratic crown profile, In addition to these conditions, the inboard and outboard load generated by the loading mechanism must be optimized, and the amplitude of the crown must be optimized.

In this disclosure, described is a set of design rules for optimizing the ITR crown profile that is relatively inexpensive and simple to manufacture. In particular, it is demonstrated that a trapezoidal crown profile with $L_0$/L=0.33, provides a nearly quadratic crown profile, where $L_0$ is the length of the ramp region of the trapezoid and L is the length of the elastomer.

Figure 4:
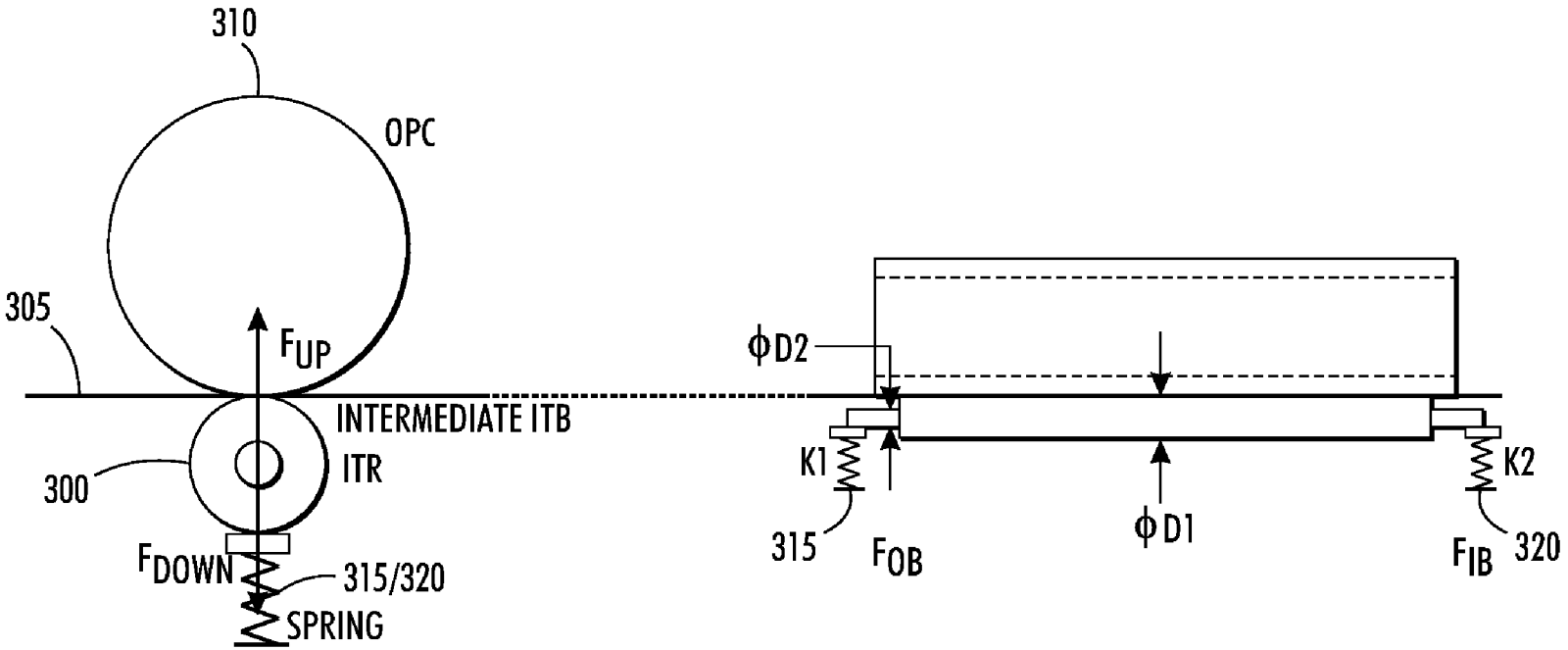
FIG. 4 illustrates an exemplary embodiment of an ITR and associated loading mechanism.

A ITR loading mechanism according to an exemplary embodiment of this disclosure is illustrated in FIG. 4. The ITR consists of an elastomer material mounted on a stiff metallic shaft. The Biased Image Transfer Roller (ITR) 300 is loaded (K1 and K2) against the back of the Intermediate Image Transfer Belt (ITB) 305 which is in contact with the photoreceptor (OPC) 310. The ITR load is provided by a mechanism utilizing inboard and outboard springs 315 and 320 with spring constants K1 and K2. The diameter of the ITR elastomer is ϕD1 and the diameter of the central shaft is ϕD2 in the figure.

It should be understood that the elastomer material may or may not be centered about the metallic shaft. In the circumstance where the elastomer material is not centered about the shaft, the forces on each end need to be somewhat unbalanced to insure a uniform nip width in the cross process direction. Otherwise, the nip will be wider on the end of the elastomer material with the longer shaft extension beyond the elastomer material, relative to the end of the elastomer material with the shorter shaft extension beyond the elastomer material.

Figure 5:
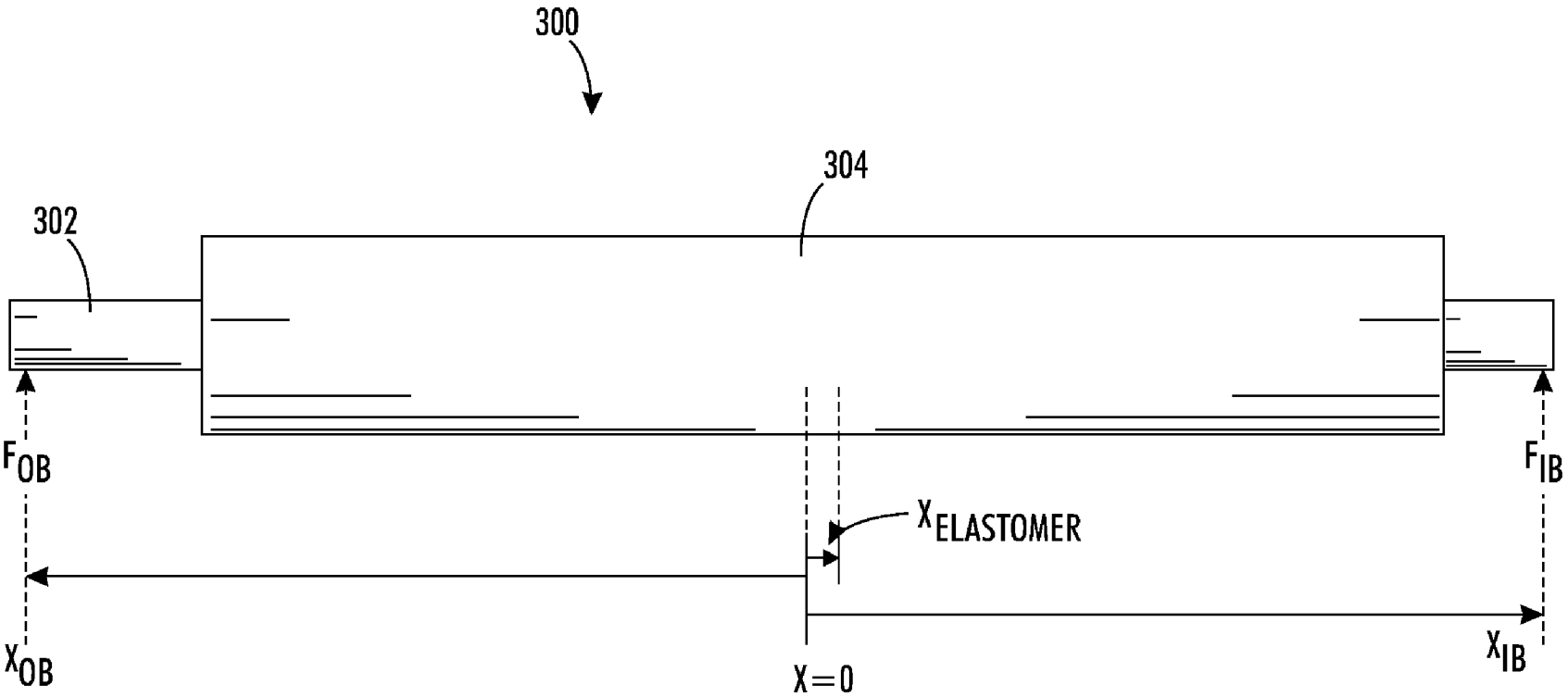
FIG. 5 illustrates one exemplary embodiment of an ITR according to this disclosure.

FIG. 5 illustrates an ITR in which the center of the elastomer, $X_{ELASTOMER}$ is displaced relative to the center of the shaft located at x=0. If the mass of the elastomer, $M_{ELASTOMER}$, is small relative to the total mass of the ITR, $m_{ITR}$, (i.e., shaft 302 & elastomer 304), then the relationship between the outboard load force $F_{OB}$ and the inboard load force $F_{IB}$ can be described by the following equations, where $X_{IB}$ is the location of the application of $F_{IB}$ and $X_{OB}$ is the location of the application of $F_{OB}$. If, as in FIG. 5, the elastomer is displaced towards the inboard side of the ITR, then $$F_{IB} - F_{OB} = (F_{DOWN} - m_{ITR}g)\frac{X_{ELASTOMER}}{X_{OB}},$$

where $F_{DOWN}=m_{ITR}g+F_{TENSION}+F_{ITB_OPC}$, $F_{TENSION}$ is the force on the ITR due to the tension and wrap of the intermediate ITB on the ITR (see FIG. 4), $F_{ITB_OPC}$ is the contact force between the intermediate ITB and OPC, and $m_{ITR}$*g is the gravitational force on the ITR. If the ITR elastomer 304 is shifted towards the outboard end of the ITR shaft, then $$F_{OB} - F_{IB} = (F_{DOWN} - m_{ITR}g)\frac{X_{ELASTOMER}}{X_{IB}}.$$

Figure 6:
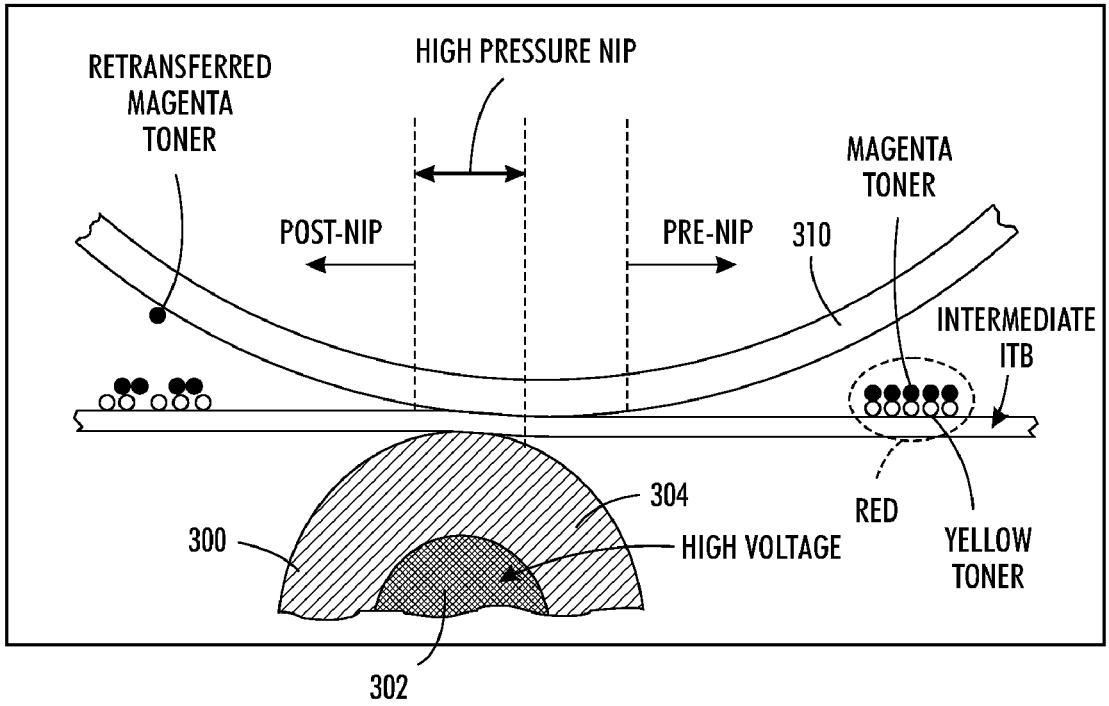
FIG. 6 illustrates the details of a transfer nip and the retransfer of toner.

FIG. 5 illustrates an ITR including a conductive core 302 and an elastomer sleeve 304. The ITR nip is shown in more detail in FIG. 6, which also illustrates the retransfer mechanism. The figure shows a red image (magenta on yellow) entering a downstream transfer nip. High fields in the downstream nip result in air breakdown within the toner pile and wrong-sign toner generation in the image. As a result, some of the top layer wrong-sign magenta toner is "retransferred" to the downstream photoreceptor OPC 310 due to the high transfer fields in the downstream nip(s). The scavenging of the magenta toner results in a color shift. If the transfer field is spatially non-uniform, then the retransfer scavenging and resulting colors will also be spatially non-uniform. The retransfer macro-uniformity defect is a manifestation of the spatially non-uniform color shifts, as is the mottle defect. Mottle refers to spatial color non-uniformity on the 0.1 mm to 5 mm length scale.

Figure 7:
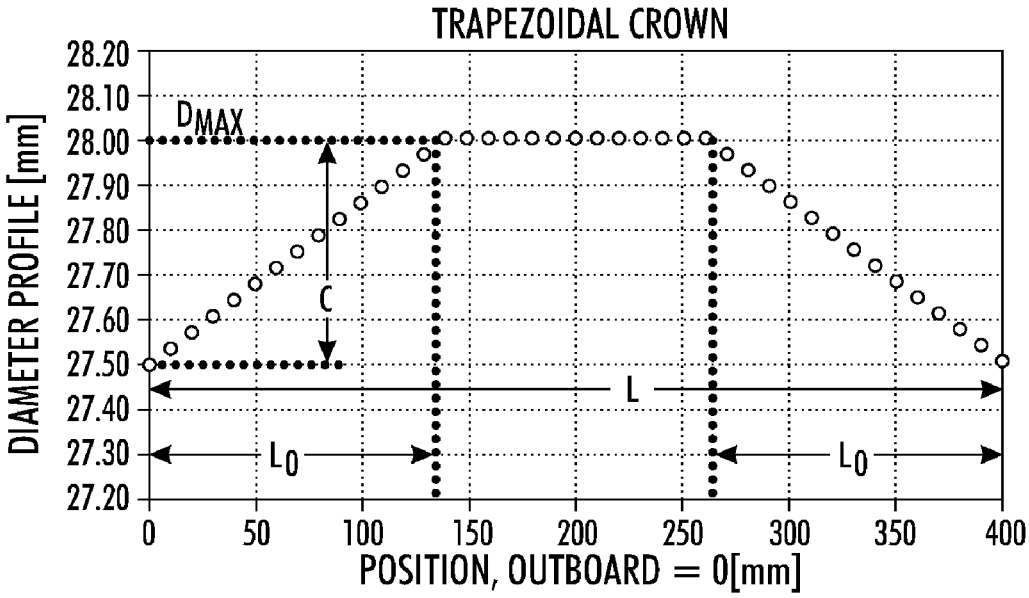
FIG. 7 is a graph of a trapezoidal crown profile associated with an exemplary embodiment of an ITR according to this disclosure.

A trapezoidal crown profile associated with an ITR is illustrated in FIG. 7. $D_{MAX}$ is the diameter of the ITR elastomer, C is the amplitude of the crown, L is the total width of the elastomer and $L_0$ is the width of the ramp region of the trapezoid. In FIG. 7, the crown amplitude is 500 microns (0.5 mm), $L_0$ is 134 mm and L=401 mm.

Figure 8:
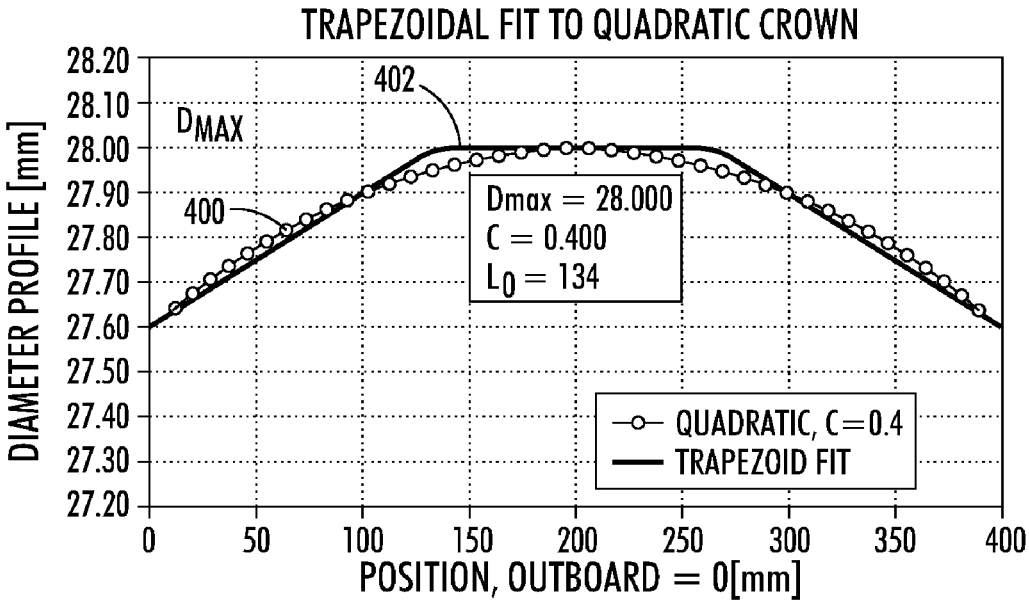
FIG. 8 is a graph illustrating a quadratic crown profile compared to a best fit trapezoidal crown profile of an exemplary ITR according to this disclosure.

In order to establish the design rules for the best fit trapezoid, a least squares fit to a quadratic crown profile was computed, where $L_0$ was varied to minimize the sum of squared deviations from the quadratic reference crown profile. In the fits C, L, and $D_{MAX}$ for the trapezoid was constrained to be the same as C,L and $D_{MAX}$ for the quadratic reference crown profile 400, as is illustrated in FIG. 8 for a crown with C=400 μm, $D_{MAX}$=500 and L=401 mm. Note that $L_0$=0.33 L=134 mm for this best-fit trapezoid 402. This procedure was repeated for crown amplitudes varying from C=100 to 500 um and for elastomer lengths ranging from L=260 to 401 mm. The results are summarized in the following table, which shows that $L_0/L=0.33$ gives the best fit trapezoidal crown profile independent of C and L.

| [mm] C | [mm] L | [mm] $L_0$ | $L_0/L$ |
|---|---|---|---|
| 300 | 401 | 134 | 0.33 |
| 300 | 330 | 108 | 0.33 |
| 300 | 260 | 86 | 0.33 |
| 100 | 401 | 134 | 0.33 |
| 200 | 401 | 134 | 0.33 |
| 300 | 401 | 134 | 0.33 |
| 500 | 401 | 134 | 0.33 |

Figure 9:
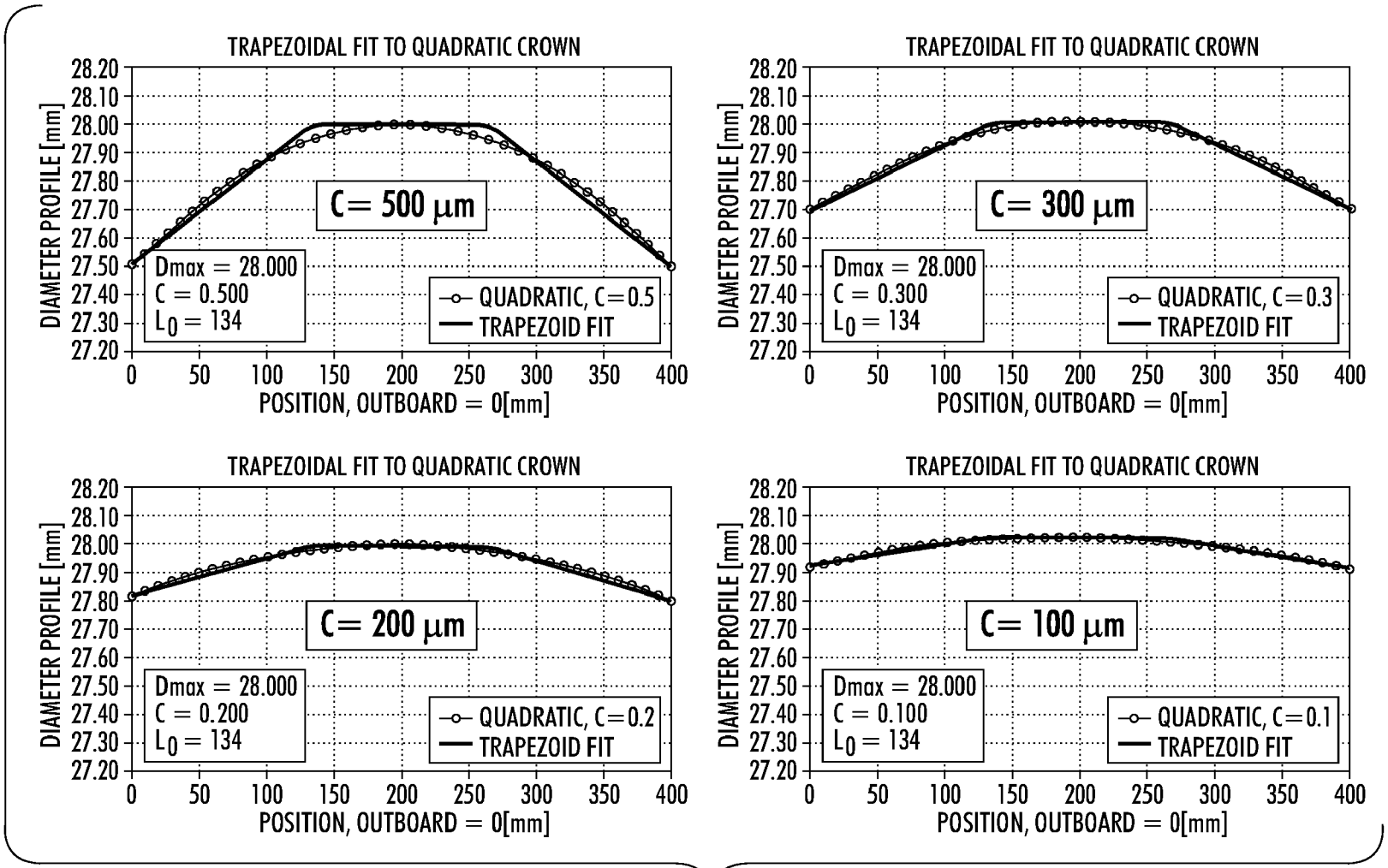
FIG. 9 is a plurality of graphs illustrating examples of ITR trapezoidal fits to a quadratic crown profile as a function of the crown amplitude.
Figure 10:
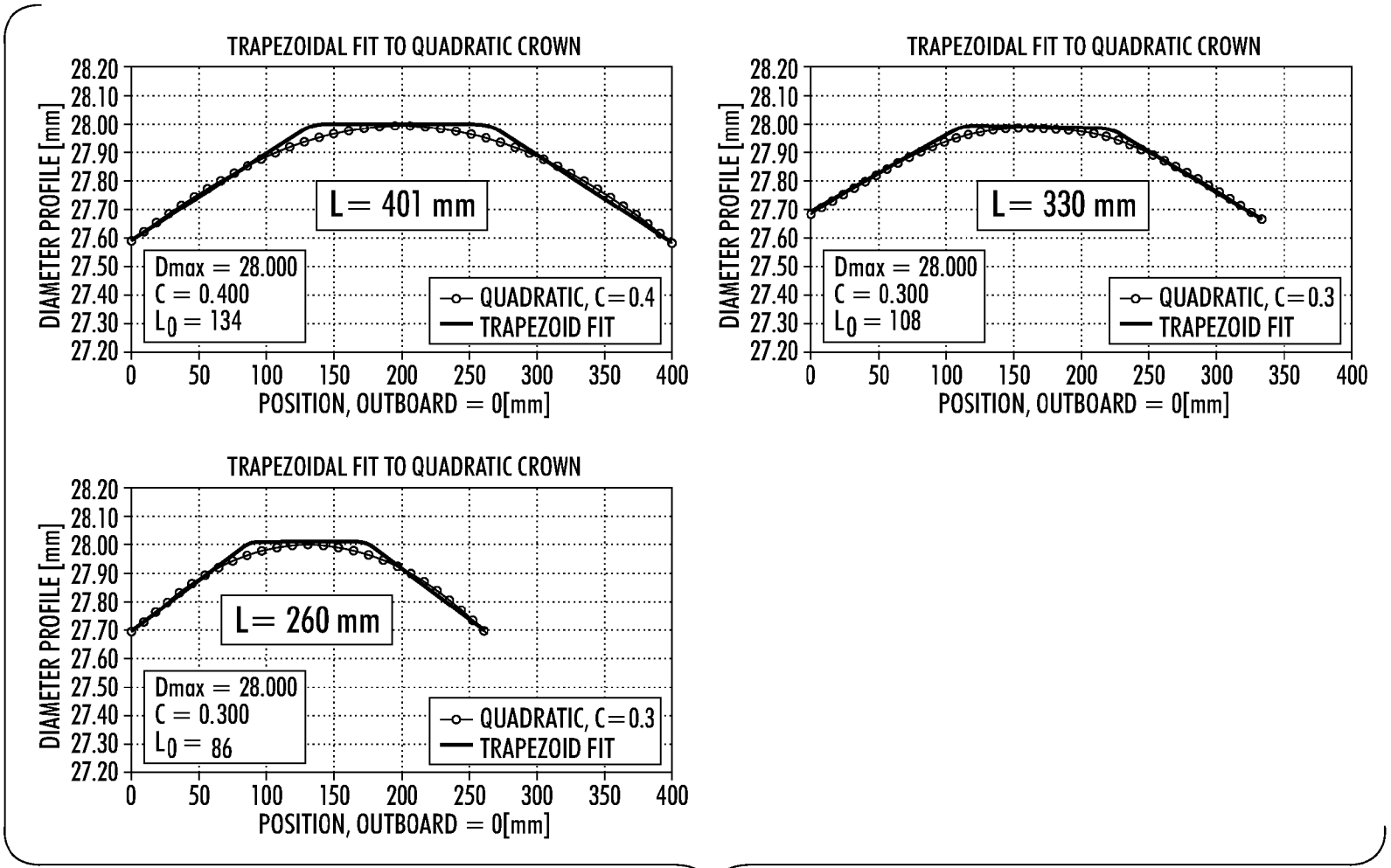
FIG. 10 is a plurality of graphs illustrating examples of ITR trapezoidal fits to a quadratic crown profile as a function of elastomer length.

Provided is a universal scaling law to be used when designing a trapezoidal crown profile. The trapezoidal fits (solid curve without circles) to the quadratic crown profile (solid curve with circles) for the data in the above table are shown in FIGS. 9 and 10. When $L_0/L=0.33$ the trapezoidal crown profile looks very similar to the quadratic crown profile in each case.

Using these and other $L_0/L=0.33$ ITRs with varying crown amplitudes in a DOE (i.e., Controlled experiments using the Design of Experiments technique), total spring force (9.0N) and crown amplitude (430 mm) combinations were determined that hit a nip width target while eliminating the cross-process nip width non-uniformity. It has been also demonstrated that the transfer field was spatially uniform across the process with this design.

It is to be understood that the disclosed embodiments are not limited to the example C, L and $D_{MAX}$ values. For example, C may be in the range of 10 microns to 2000 microns (very soft and/or very wide), and $D_{MAX}$ may be within the range of 10 mm to 1000 mm. Preferably C is within the range of 100 microns to 5000 microns, L is within the range of 260 mm to 401 mm and $D_{MAX}$ is within the range of 10 mm to 40 mm.

Substantially, the disclosed embodiments comprise:

Grinding the ITR elastomer into a trapezoidal crown profile with $L_0/L=0.33$.

Optimizing the (1) load force on the ITR shaft, (2) the durometer of the ITR elastomer, and (3) the amplitude of the crown profile to achieve the nip width and nip pressure targets, and to achieve a uniform nip width and pressure across the process (i.e., along the length of the ITR elastomer).

Some of the potential advantages associated with the substantially quadratic profile nip include a uniform nip width across the process and uniform nip pressure across the process, and uniform color across the process, including mixed colors with two or more separations (in a 4-color engine the separations are yellow, magenta, cyan, and black). In addition, the retransfer smile uniformity defect is mitigated, transfer-induced mottle is reduced and is more uniform across the process, more uniform print quality is produced across the process; more robust image quality is produced across the process (less sensitive to noise factors); there is a reduction in service calls due to elimination of cross-process image quality non-uniformity; and the run cost is reduced.

The disclosed embodiments are applicable to any engine using ITRs for image transfer. It is particularly beneficial to color tandem IBT (Intermediate Belt Transfer) architectures.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image transfer roller (ITR) for the transfer of an image from a first substrate to a second substrate comprising:

a shaft, the shaft including a first longitudinal end and a second longitudinal end; and an elastomer material covering all or a portion of the shaft, the outer surface of the elastomer material adapted to have a substantially quadratic crown profile, wherein the image transfer roller is operatively associated with generating a uniform image transfer electrical field across a nip for the transfer of an image from the first substrate to the second substrate, the nip associated with the longitudinal engagement of the elastomer material with one of the first and second substrates by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material, and wherein $D_{max}$ represents the maximum diameter of the ITR determined at the outer surface of the elastomer material, the outer surface of the elastomer material is adapted to have a trapezoidal profile, the trapezoidal profile including a crown of amplitude C, a crown of longitudinal width $L_1$, a first ramp extending from a first longitudinal end of the elastomer material to the crown and extending a longitudinal width of $L_0$ from the first longitudinal end of the elastomer material to the crown, a second ramp extending from a second longitudinal end of the elastomer material to the crown and extending a longitudinal width of $L_0$ from the second longitudinal end of the elastomer material to the crown, L representing the sum of the first ramp longitudinal width $L_0$, the second ramp longitudinal width $L_0$, and the longitudinal width $L_1$ of the crown, where $L_0/L$ equals 0.33.

2. The image transfer roller (ITR) according to claim 1, wherein C is within the range of 100 μm to 500 μm, L is within the range of 260 mm to 401 mm, and $D_{max}$ is within the range of 10 to 40 mm.

3. The image transfer roller (ITR) according to claim 1, wherein the first substrate is one of a photoreceptor drum, a photoreceptor belt, an intermediate image transfer drum and an intermediate image transfer belt, and the second substrate is one of an intermediate image transfer belt, an intermediate image transfer drum and a media sheet.

4. The image transfer roller (ITR) according to claim 1, wherein the first substrate is a photoreceptor drum, the second substrate is an intermediate image transfer belt and the image is developed on the photoreceptor drum using a xerographic process.

5. The image transfer roller (ITR) according to claim 1, wherein the first substrate is one of a photoreceptor drum, a photoreceptor belt, an intermediate image transfer drum, and an intermediate image transfer belt, and the second substrate is one of an intermediate image transfer belt, an intermediate image transfer drum and a media sheet.

6. The image transfer roller (ITR) according to claim 1, wherein the first substrate is a photoreceptor drum, the second substrate is an intermediate image transfer belt and the image is developed on the photoreceptor drum using a xerographic process.

7. The image transfer roller (ITR) according to claim 1, wherein the shaft is cylindrically shaped.

8. The image transfer roller according to claim 1, wherein the shaft is conductive; and the image transfer roller is adapted to be electrically biased to generate the uniform image transfer electrical field across the nip for the transfer of an image.

9. The image transfer roller according to claim 1, wherein the nip is associated with the longitudinal engagement of the elastomer material with the second substrate and the engagement of the second substrate with the first substrate by the application of the first force to the first longitudinal end and the second force to the second longitudinal end.

10. The image transfer roller according to claim 1, wherein the shaft is conductive; and the image transfer roller is adapted to be grounded to generate the uniform image transfer electrical field across the nip for the transfer of an image.

11. The image transfer roller according to claim 1, wherein the nip is associated with the longitudinal engagement of the elastomer material with the first substrate and the engagement of the first substrate with the second substrate by application of the first force to the first longitudinal end and the second force to the longitudinal end.

12. An image marking device comprising:

a photoreceptor drum;

an exposure station operatively associated with the photoreceptor drum and configured to form an electrostatic image on the photoreceptor drum;

a developer system operatively associated with the photoreceptor drum and configured to develop the electrostatic image with a toner material;

an intermediate image transfer belt operatively associated with the photoreceptor drum;

an image transfer roller (ITR) operatively associated with the transfer of the developed electrostatic image from the photoreceptor drum to the intermediate image transfer belt, the ITR comprising:

a shaft, the shaft including a first longitudinal end and a second longitudinal end; and an elastomer material covering all or a portion of the shaft, the outer surface of the elastomer material adapted to have a substantially quadratic crown profile, wherein the image transfer roller is operatively associated with generating a uniform image transfer electrical field across a nip for the transfer of the developed image from the photoreceptor drum to the intermediate image transfer belt, the nip associated with the longitudinal engagement of the elastomer material with one of the intermediate image transfer belt and the photoreceptor drum by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material, and wherein $D_{max}$ represents the maximum diameter of the ITR determined at the outer surface of the elastomer material, the outer surface of the elastomer material is adapted to have a trapezoidal profile, the trapezoidal profile including a crown of amplitude C, a crown of longitudinal width $L_1$, a first ram extending from a first longitudinal end of the elastomer material to the crown and extending a longitudinal width of $L_0$ from the first longitudinal end of the elastomer material to the crown, a second ramp extending from a second longitudinal end of the elastomer material to the crown and extending a longitudinal width of $L_0$ from the second longitudinal end of the elastomer material to the crown, L representing the sum of the first ramp longitudinal width $L_0$, the second ramp longitudinal width $L_0$, and the longitudinal width $L_1$ of the crown, where $L_0/L$ equals 0.33.

13. The image marking device according to claim 12, wherein C is within the range of 100 μm to 500 μm, L is within the range of 260 mm to 401 mm, and $D_{max}$ is within the range of 10 to 40 mm.

14. The image marking device according to claim 12, wherein the image is developed on the photoreceptor drum using a xerographic process.

15. The image marking device according to claim 12, wherein the shaft is cylindrically shaped.

16. The image marking device according to claim 12, wherein the shaft is conductive; and the image transfer roller is adapted to be electrically biased to generate the uniform image transfer electrical field across the nip for the transfer of an image.

17. The image marking device according to claim 12, wherein the image transfer roller shaft is conductive; and the image transfer roller is adapted to be grounded to generate the uniform image transfer electrical field across the nip for the transfer of an image.

18. An image marking apparatus comprising:

an intermediate image transfer belt;

a plurality of image marking devices operatively associated with the transferring of an image to the intermediate image transfer belt, each image marking device associated with a distinct toner material colorant; and an image transfer station operatively associated with the transfer of an image from the intermediate image transfer belt to a media substrate, wherein each image marking device comprises:

a photoreceptor drum;

an exposure station operatively associated with the photoreceptor drum and configured to form an electrostatic image on the photoreceptor drum;

a developer system operatively associated with the photoreceptor drum and configured to develop the electrostatic image with a toner material;

an image transfer roller (ITR) operatively associated with the transfer of the developed electrostatic image from the photoreceptor drum to the intermediate image transfer belt, the ITR comprising:

a shaft, the shaft including a first longitudinal end and a second longitudinal end; and an elastomer material covering all or a portion of the shaft, the outer surface of the elastomer material adopted to have a substantially quadratic profile, wherein the image transfer roller is operatively associated with generating a uniform image transfer electrical field across a nip for the transfer of the developed image from the photoreceptor drum to the intermediate image transfer belt, the nip associated with the longitudinal engagement of the elastomer material with one of the intermediate image transfer belt and the photoreceptor drum by the application of a first force to the first longitudinal end and a second force to the second longitudinal end, the first and second forces substantially orthogonal to the nip, and the first and second forces properly balanced relative to the other end to insure that the contact pressure profile in the longitudinal direction is symmetrical about the center of the elastomer material, and wherein $D_{max}$ represents the maximum diameter of the ITR determined at the outer surface of the elastomer material, the outer surface of the elastomer material is adapted to have a trapezoidal profile, the trapezoidal profile including a crown of amplitude C, a crown of longitudinal width $L_1$, a first ram extending from a first longitudinal end of the elastomer material to the crown and extending a longitudinal width of $L_0$ from the first longitudinal end of the elastomer material to the crown, a second ramp extending from a second longitudinal end of the elastomer material to the crown and extending a longitudinal width of $L_0$ from the second longitudinal end of the elastomer material to the crown, L representing the sum of the first ramp longitudinal width $L_0$, the second ram longitudinal width $L_0$, and the longitudinal width $L_1$ of the crown, where $L_0/L$ equals 0.33.

19. The image marking apparatus according to claim 18, wherein C is within the range of 100 μm to 500 μm, L is within the range of 260 mm to 401 mm, and $D_{max}$ is within the range of 10 mm to 40 mm.

20. The image marking apparatus according to claim 18, wherein the toner material colorants are two or more of cyan, yellow, magenta, black, orange, violet, red, green and blue.

21. The image marking apparatus according to claim 18, wherein the image is developed on the photoreceptor drum using a xerographic process.

22. The image marking apparatus according to claim 18, wherein the shaft is cylindrically shaped.

* * * * *